US008860697B2

(12) United States Patent
Lee

(10) Patent No.: US 8,860,697 B2
(45) Date of Patent: Oct. 14, 2014

(54) DISPLAY DRIVING DEVICE CAPABLE OF REDUCING DISTORTION OF SIGNAL AND/OR POWER CONSUMPTION, AND DISPLAY DEVICE HAVING THE SAME

(75) Inventor: Yong-Jae Lee, Yongin-si (KR)

(73) Assignee: ANAPASS Inc., Seoul (KR)

( * ) Notice: Subject to any disclaimer, the term of this patent is extended or adjusted under 35 U.S.C. 154(b) by 1028 days.

(21) Appl. No.: 12/248,053

(22) Filed: Oct. 9, 2008

(65) Prior Publication Data

US 2009/0096771 A1 Apr. 16, 2009

(30) Foreign Application Priority Data

Oct. 10, 2007 (KR) ..... 10-2007-0101770
Jul. 9, 2008 (KR) ..... 10-2008-0066528

(51) Int. Cl.
*G09G 5/00* (2006.01)
*G09G 3/36* (2006.01)
*G09G 3/20* (2006.01)

(52) U.S. Cl.
CPC ..... *G09G 3/3611* (2013.01); *G09G 3/20* (2013.01); *G09G 2310/08* (2013.01); *G09G 2370/08* (2013.01)
USPC ..... 345/204; 345/103; 345/90

(58) Field of Classification Search
USPC ..... 345/103, 204
See application file for complete search history.

(56) References Cited

U.S. PATENT DOCUMENTS

| | | | | |
|---|---|---|---|---|
| 7,313,197 | B2 | 12/2007 | Cheung et al. | |
| 2002/0008684 | A1 * | 1/2002 | Udo et al. | 345/89 |
| 2005/0152189 | A1 * | 7/2005 | Kim et al. | 365/185.29 |
| 2006/0125757 | A1 * | 6/2006 | Kang et al. | 345/98 |
| 2006/0238477 | A1 * | 10/2006 | Lew et al. | 345/94 |
| 2006/0284816 | A1 * | 12/2006 | Jang et al. | 345/98 |
| 2007/0139340 | A1 * | 6/2007 | Lin et al. | 345/98 |
| 2007/0195048 | A1 * | 8/2007 | Nam et al. | 345/98 |
| 2008/0174539 | A1 * | 7/2008 | Hu et al. | 345/99 |
| 2008/0246752 | A1 * | 10/2008 | Lee | 345/213 |
| 2009/0128453 | A1 * | 5/2009 | Moun | 345/60 |

FOREIGN PATENT DOCUMENTS

| | | |
|---|---|---|
| KR | 1020050048423 | 5/2005 |
| KR | 1020070078949 | 8/2007 |
| TW | 495730 | 7/2011 |

* cited by examiner

*Primary Examiner* — Joe H Cheng
*Assistant Examiner* — Benyam Ketema
(74) *Attorney, Agent, or Firm* — Sherr & Jiang, PLLC

(57) ABSTRACT

A display driving device includes a plurality of data drivers; and a timing controller including a data transmission unit. The data transmission unit transmits data to the data drivers, The data transmission unit controls an electrical signal based on a distance difference between each of the data drivers and the data transmission unit, to reduce distortion of the electrical signal and/or power consumption due to the distance difference, and transmits the controlled electrical signal. The electrical signal corresponds to the data.

16 Claims, 10 Drawing Sheets

DISPLAY DRIVING DEVICE CAPABLE OF REDUCING DISTORTION OF SIGNAL AND/OR POWER CONSUMPTION, AND DISPLAY DEVICE HAVING THE SAME

CROSS-REFERENCE TO RELATED APPLICATION

This application claims the benefit of Korean Patent Application No. 10-2007-101770, filed Oct. 10, 2007, and 10-2008-66528, filed Jul. 9, 2008, the contents of which are hereby incorporated herein by reference in their entirety.

BACKGROUND

1. Field of the Invention

Embodiments relate to a display device and, more particularly, to a display driving device capable of reducing distortion of signals and a display device having the same.

2. Description of Related Art

Flat panel displays (FPDs), a different type of display device from cathode-ray tubes (CRTs), may include liquid crystal displays (LCDs), organic light emitting diodes (OLEDs), and plasma display panels (PDPs).

In general, a display device may include a timing controller, a data driver (or a source driver), a scan driver (or a gate driver), and a display panel.

As the display panel becomes larger, the display device tends to use a plurality of data drivers to display an image. That is, each of the data drivers receives data from the timing controller and outputs the received data to the display panel.

SUMMARY

In some embodiments, a display driving device includes a plurality of data drivers; and a timing controller including a data transmission unit. The data transmission unit transmits data to the data drivers, The data transmission unit controls an electrical signal based on a distance difference between each of the data drivers and the data transmission unit, to reduce distortion of the electrical signal and/or power consumption due to the distance difference, and transmits the controlled electrical signal. The electrical signal corresponds to the data, The data transmission unit may perform pre-emphasis on the electrical signal based on the distance difference. A peak-peak voltage of the controlled electrical signal may increase with an increase in the distance difference.

In one embodiment, the data transmission unit may sequentially transmit the electrical signal to each of the data drivers. In other embodiment, the data transmission unit may transmit the electrical signal to at least some of the data drivers at the same time.

The timing controller may include a timing control unit configured to transmit the data and a driver address corresponding to the data and the data transmission unit configured to recognize the distance difference based on the driver address.

The data transmission unit may include a plurality of pre-emphasis units respectively corresponding to the data drivers. Each pre-emphasis unit is preset according to the distance difference. Also, the timing controller may include a timing control unit configured to transmit the data to each of the pre-emphasis units.

Each of the data drivers may include an equalization unit, the equalization unit configured to use an equalization coefficient preset based on the distance difference to equalize the transmitted electrical signal.

In some embodiments, a display driving device includes a timing controller and a plurality of data drivers. Each of the data drivers includes an equalization unit. The equalization unit uses an equalization coefficient preset based on a distance difference between each of the data driver and the timing controller to equalize an electrical signal transmitted by the timing controller.

The timing controller may control the electrical signal based on the distance difference between each of the data drivers and a data transmission unit to reduce distortion of the electrical signal and/or power consumption due to the distance difference, and transmits the controlled electrical signal. The electrical signal corresponds to data transmitted from the timing controller, The data transmission unit may perform pre-emphasis on the electrical signal based on the distance difference.

In some embodiments, a display device includes a plurality of data drivers, a timing controller including a data transmission unit configured to transmit data to each of the data drivers, and a scan driver configured to receive scan data from the timing controller. The data transmission unit may control an electrical signal based on a distance difference between each of the data drivers and the data transmission unit to reduce distortion of the electrical signal and/or power consumption due to the distance difference, and transmits the controlled electrical signal. The electrical signal corresponds to the data, The display device may correspond to a liquid crystal display (LCD), an organic light emitting diode (OLED), or a plasma display panel (PDP).

The data transmission unit may perform pre-emphasis on the electrical signal based on the distance difference.

Each of the data drivers may include an equalization unit, the equalization unit configured to use an equalization coefficient preset based on the distance difference to equalize the transmitted electrical signal.

In some embodiments, a display device includes a timing controller, a plurality of data drivers, and a scan driver configured to receive scan data from the timing controller. Each of the data drivers may include an equalization unit, the equalization unit configured use an equalization coefficient preset based on a distance difference between each of the data driver and the timing controller to equalize an electrical signal transmitted by the timing controller.

The display device may correspond to a liquid crystal display (LCD), an organic light emitting diode (OLED), or a plasma display panel (PDP).

The timing controller controls an electrical signal based on a distance difference between each of the data drivers and the data transmission unit to reduce distortion of the electrical signal and/or power consumption due to the distance difference, and transmits the controlled electrical signal. The electrical signal corresponds to data transmitted from the timing controller The data transmission unit may perform pre-emphasis on the electrical signal based on the distance difference.

DETAILED DESCRIPTION

Figure 1:
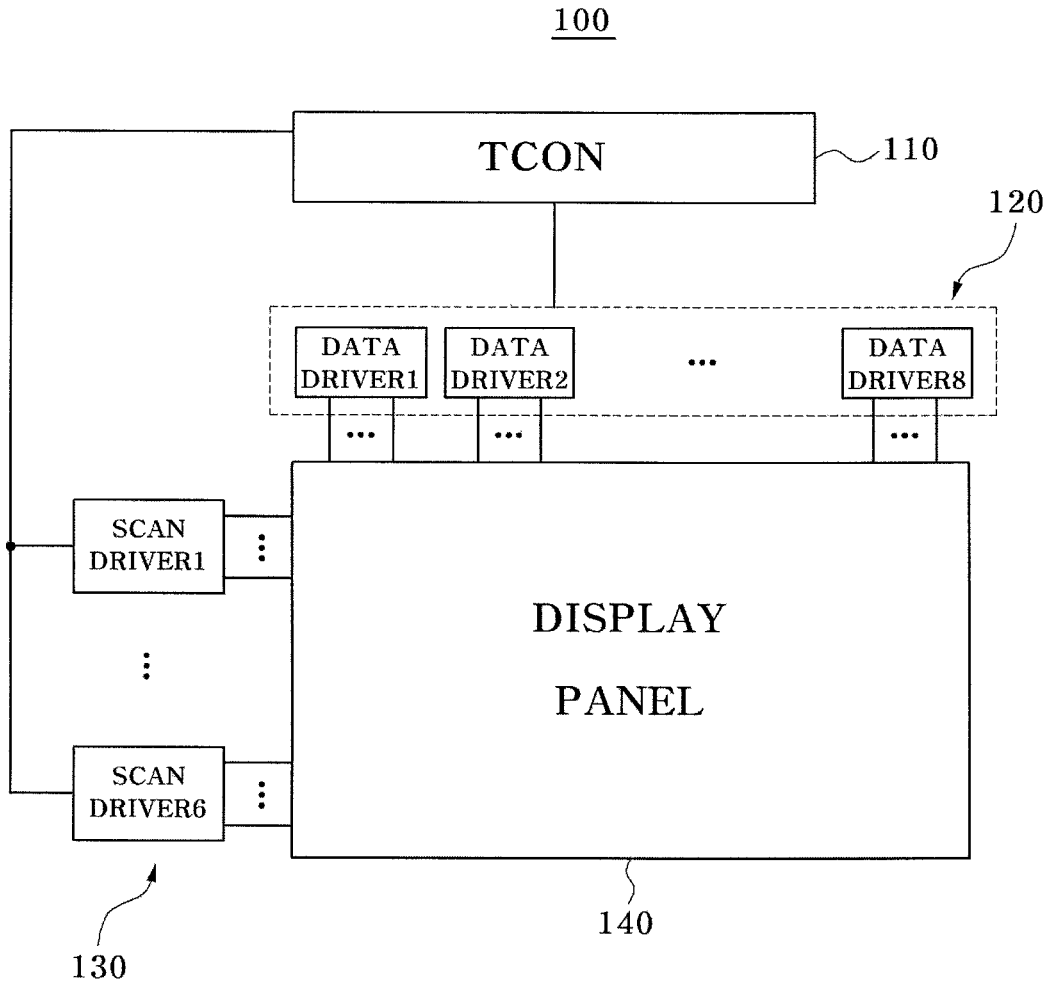
FIG. 1 is a block diagram illustrating a display device according to an example embodiment of the present invention.

Since example embodiments of the present invention are provided only for structural and functional descriptions of the present invention, the invention should not be construed as limited to the embodiments set forth herein. Thus, it will be clearly understood by those skilled in the art that the example embodiments of the present invention may be embodied in different forms and include equivalents that can realize the spirit of the present invention.

The terminology used herein should be understood as follows.

It will be understood that, although the terms first, second, etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present invention.

As used herein, the term "and/or" indicates any combination of listed items as well as any individual item by itself. Thus, "first, second, and/or third items" not only include a first, second, or third item but also mean any and all combinations of one or more of the first, second, and third items.

It will be understood that when an element or layer is referred to as being "on", "connected to" or "coupled to" another element or layer, it can be directly on, connected or coupled to the other element or layer, or intervening elements or layers may be present. In contrast, when an element is referred to as being "directly on," "directly connected to" or "directly coupled to" another element or layer, there are no intervening elements or layers present. Meanwhile, spatially relative terms, such as "between" and "directly between" or "adjacent to" and "directly adjacent to" and the like, are used herein to describe one element or feature's relationship to another element(s) or feature(s) as illustrated in the figures and should be interpreted similarly.

In the following disclosure, elements referred to in the singular using "a", "an" and "the" may be present in the plural, unless the context clearly indicates otherwise. It will be further understood that the terms "comprises" and/or "comprising," when used in this specification, specify the presence of stated features, numbers, steps, operations, elements, components, and/or groups thereof, but do not preclude the presence or addition of one or more other features, numbers, steps, operations, elements, components, and/or groups thereof.

Unless expressly defined in a specific order herein, the order in which steps of the present invention are performed may be changed. That is, steps may be performed in a specified order, at substantially the same time, or in reverse order.

Unless otherwise defined, all terms (including technical and scientific terms) used herein have the same meaning as commonly understood by one of ordinary skill in the art to which this invention belongs. It will be further understood that terms defined in common dictionaries should be interpreted as having meanings that are consistent with the context of the relevant art and this specification and will not be interpreted in an idealized or overly formal sense unless expressly so defined herein.

FIG. 1 is a block diagram illustrating a display device according to an example embodiment of the present invention.

Referring to FIG. 1, a display device 100 includes a timing controller 110, a plurality of data drivers 120, a plurality of scan drivers 130, and a display panel 140.

For example, the display device 100 may correspond to a flat panel display (FPD) such as a liquid crystal display (LCD), an organic light emitting diode (OLED), or a plasma display panel (PDP).

As in a typical FPD, the timing controller 110 may transmit data to each of the data driver 120 and transmit scan data to each of the scan drivers 130, and the display panel 140 operates by the data drivers 120 and the scan drivers 130.

When the timing controller 110 transmits an electrical signal to the data driver 120, the display device 100 controls operation between the timing controller 110 and the data driver 120 to reduce distortion of the electrical signal and/or power consumption. The distortion may occur due to a difference in distance between the timing controller 110 and the data driver 120.

Hereinafter, the operation between the timing controller 110 and the data driver 120 will be described with reference to the drawings.

Figure 2:
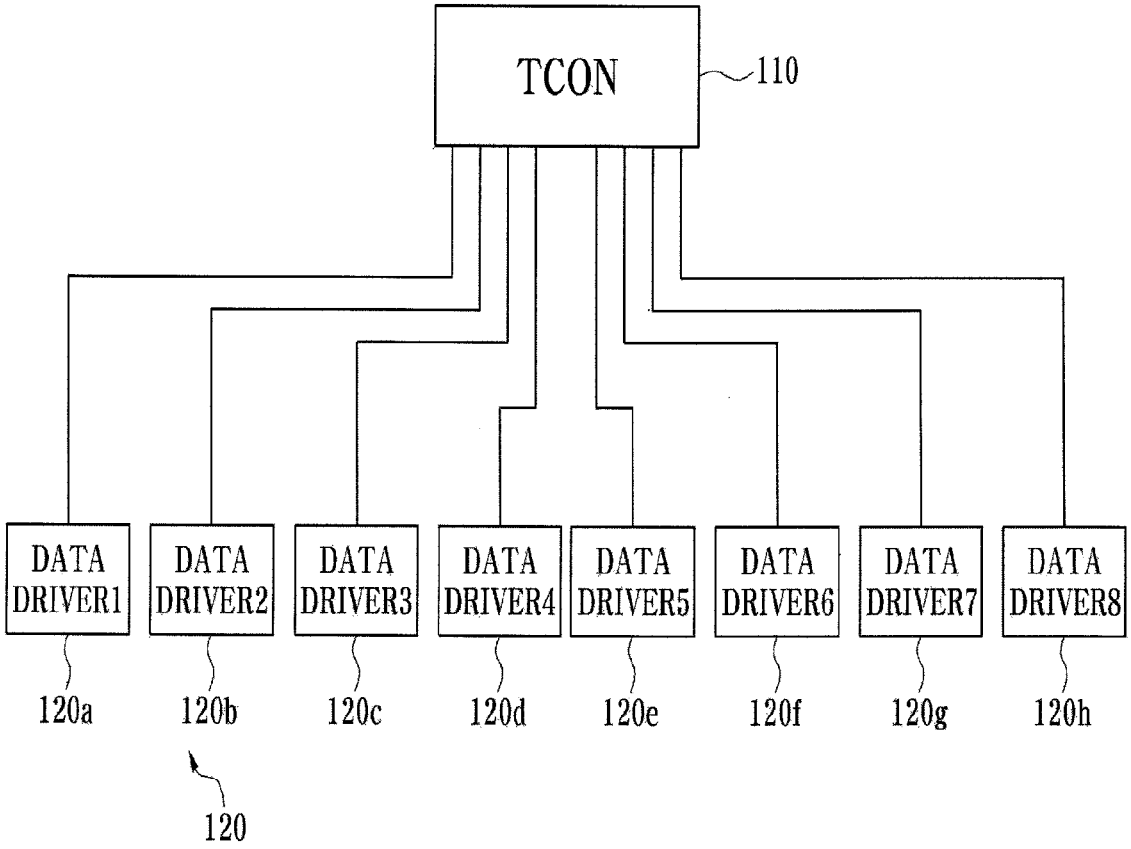
FIGS. 2 through 4 are diagrams for illustrating connection structures between a timing controller and data drivers in FIG. 1.
Figure 3:
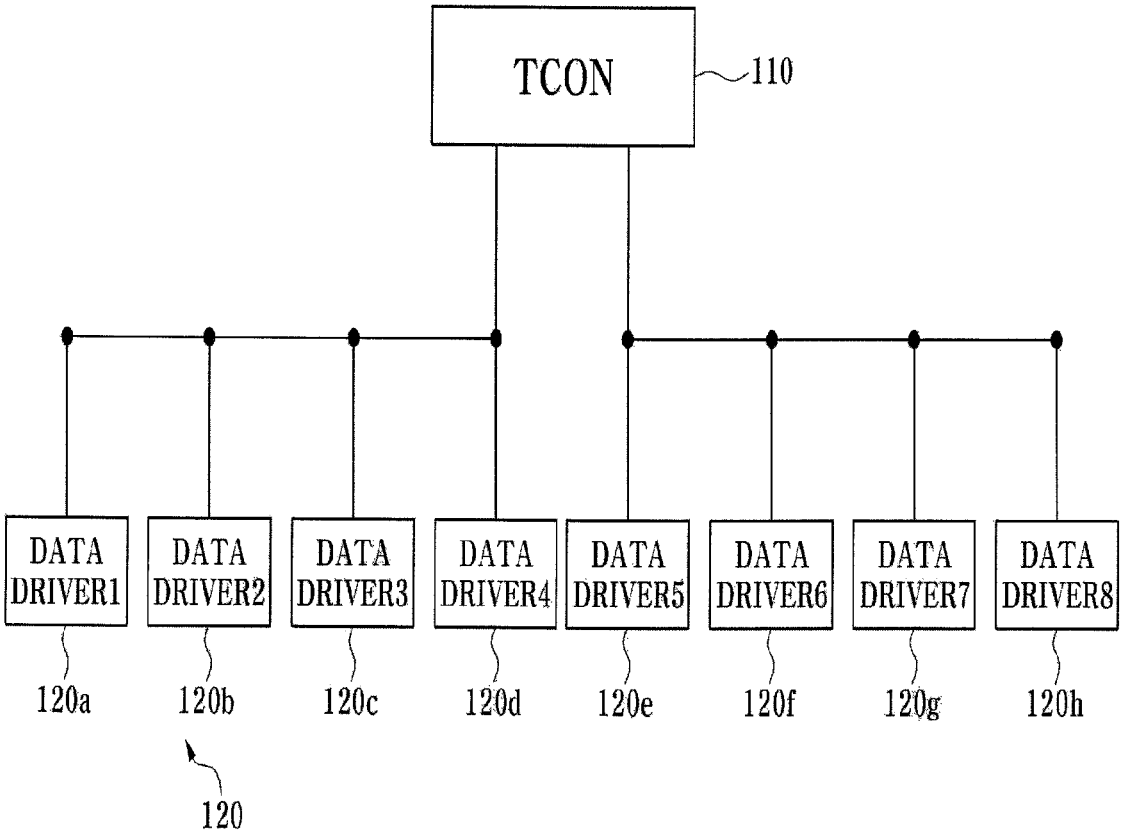
Figure 4:
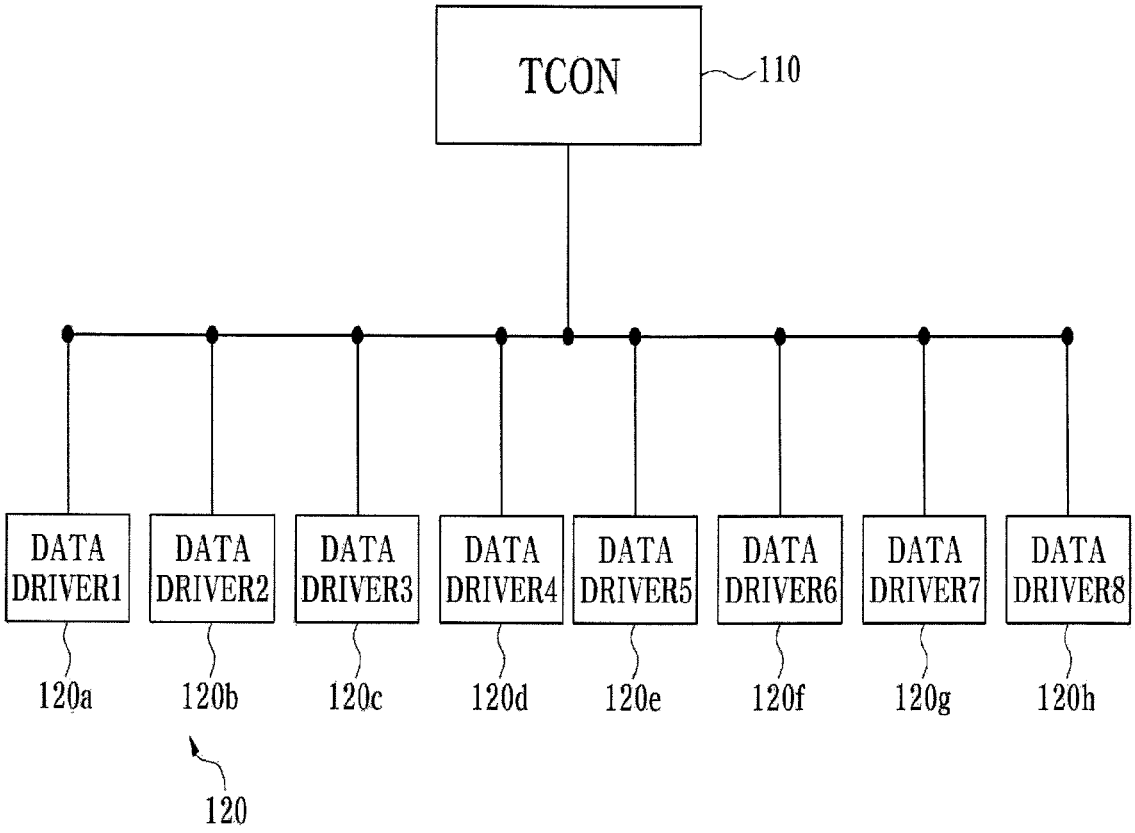

FIGS. 2 through 4 are diagrams for illustrating connection structures between a timing controller and data drivers in FIG. 1.

In FIG. 2, the timing controller 110 is independently connected to each of data drivers 120*a* to 120*h*. In FIG. 3, the timing controller 110 is independently connected to each of a first group of data drivers 120*a* to 120*d* and a second group of data drivers 120*e* to 120*h*. In FIG. 4, the timing controller 110 is connected to all data drivers 120*a* to 120*h* at once.

The timing controller 110 may have a 1:N connection structure (N is a natural number) with the data drivers 120*a* to 120*h*. For example, FIG. 2 illustrates a 1:8 connection structure, FIG. 3 illustrates a 1:2 connection structure, and FIG. 4 illustrates a 1:1 connection structure.

Meanwhile, although not necessary, the timing controller 110 may transmit an electrical signal to the respective data drivers 120*a* to 120*h* using different methods according to physical structures between the timing controller 110 and the data drivers 120*a* to 120*h* as described with reference to FIGS. 2 through 4.

When the timing controller 110 is connected to the data drivers 120*a* to 120*h* in a manner illustrated in FIG. 2 or 3, the timing controller 110 may transmit an electrical signal to at least some of the data drivers 120*a* to 120*h* simultaneously or sequentially. When the timing controller 110 is connected to the data drivers 120*a* to 120*h* in a manner illustrated in FIG. 4, the timing controller 110 may sequentially transmit an electrical signal to each of the data drivers 120*a* to 120*h*.

Figure 5:
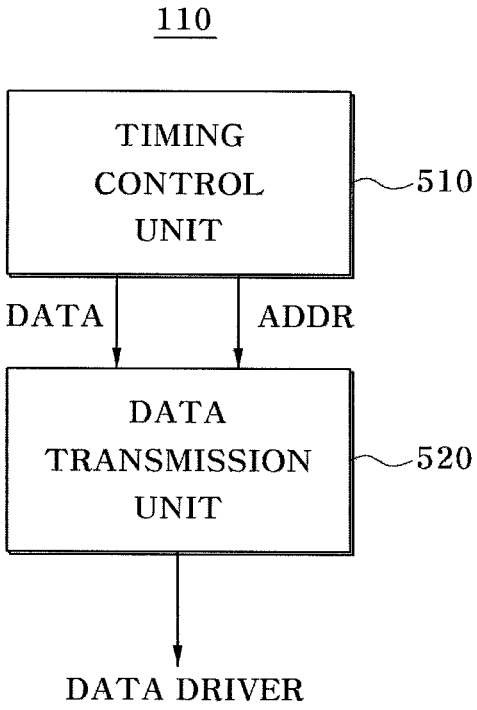
FIG. 5 is a block diagram illustrating an example embodiment of the timing controller in FIG. 1.

FIG. 5 is a block diagram illustrating an example embodiment of the timing controller in FIG. 1.

Referring to FIG. 5, the timing controller 110 may include a timing control unit 510 and a data transmission unit 520.

Like a timing controller in a typical FPD, the timing controller 510 controls the data drivers 120 and the scan drivers 130 in order to display an image on the display panel 140.

The data transmission unit 520 may transmit data to the data driver 120. When the timing control unit 510 transmits data to the data driver 120, the data transmission unit 520 may control an electrical signal corresponding to the data based on a distance difference between the data driver 120 and the data transmission unit 520 and transmit the controlled electrical signal.

More specifically, the timing control unit 510 may transmit data and a driver address corresponding to the data to the data transmission unit 520. The driver address may be used to simplify a circuit in the data transmission unit 520 and to identify the data drivers 120*a* to 120*h*. The data transmission unit 520 may recognize a distance difference between the data driver 120 and the data transmission unit 520 based on the driver address.

Hereinafter, a process of controlling an electrical signal in the data transmission unit 520 will be described with reference to FIGS. 6 through 7.

Figure 6:
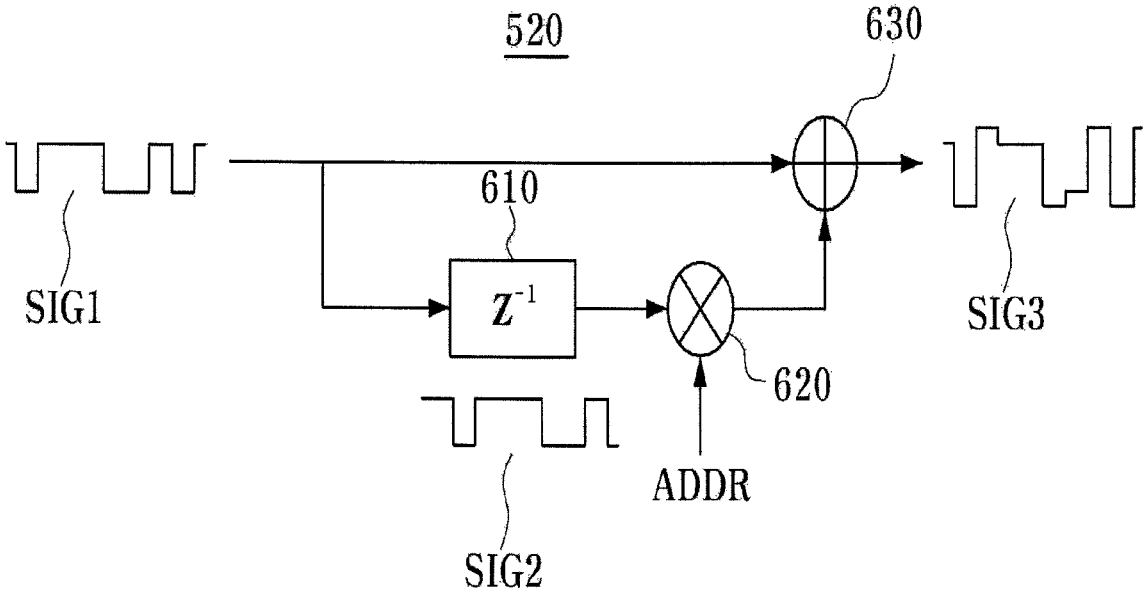
FIG. 6 is a block diagram illustrating a data transmission unit in FIG. 5.

FIG. 6 is a block diagram illustrating a data transmission unit in FIG. 5.

Referring to FIG. 6, the data transmission unit 520 may include a finite impulse response (FIR) filter 610, a mixer 620, and a summing unit 630. The data transmission unit 520 may perform pre-emphasis on an electrical signal based on a distance difference between the data driver 120 and the data transmission unit 520.

The FIR filter 610 may correspond to a digital filter, which depends on a present electrical signal SIG1 and a previous electrical signal SIG2, and compares the present electrical signal SIG1 with the previous electrical signal SIG2. When the present electrical signal SIG1 is at the same level as the previous electrical signal SIG2, the FIR filter 610 may output an electrical signal SIG3 at a normal level. When the present electrical signal SIG1 is at a different level from the previous electrical signal SIG2, the FIR filter 610 may output an electrical signal SIG3 having a greater magnitude.

The mixer 620 may determine the magnitude of an electrical signal, which depends on a driver address ADDR transmitted by the timing control unit 510. The summing unit 630 may add the present electrical signal SIG1 and the magnitude determined by the mixer 620.

Figure 7:
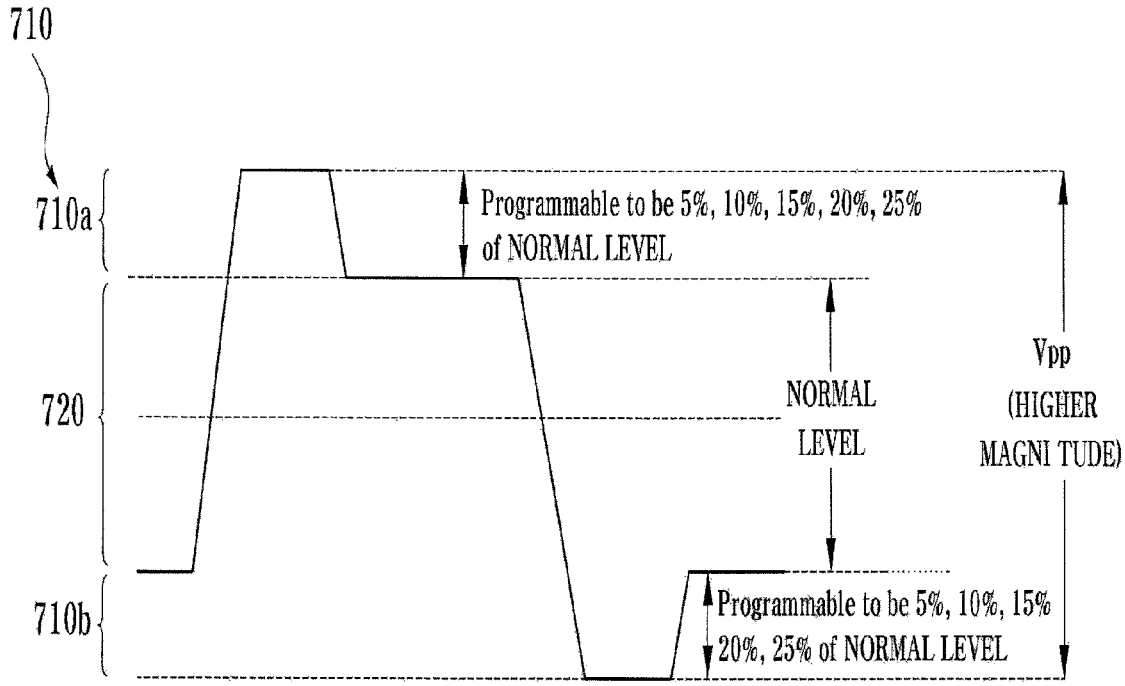
FIG. 7 is a diagram for illustrating an output signal of the data transmission unit in FIG. 6.

FIG. 7 is a diagram for illustrating an output signal of the data transmission unit in FIG. 6.

In FIG. 7, a first portion 710 illustrates a pre-emphasis result of an electrical signal transmitted by the data transmission unit 520, and a second portion 720 illustrates a normal level of an electrical signal transmitted by the timing control unit 510.

A magnitude of the first portion 710 may depend on a driver address. In one embodiment, a peak-peak voltage VPP of an electrical signal may increase with an increase in a distance difference between the data transmission unit 520 and the data driver 120.

For example, in case of first and second data drivers 120*a* and 120*b*, the first portion 710 may correspond to 125% of the second portion 720. In case of a third data driver 120*c*, the first portion 710 may correspond to 110% of the second portion 720. In case of a fourth data driver 120*d*, the first portion 710 may correspond to 105% of the second portion 720.

Figure 8:
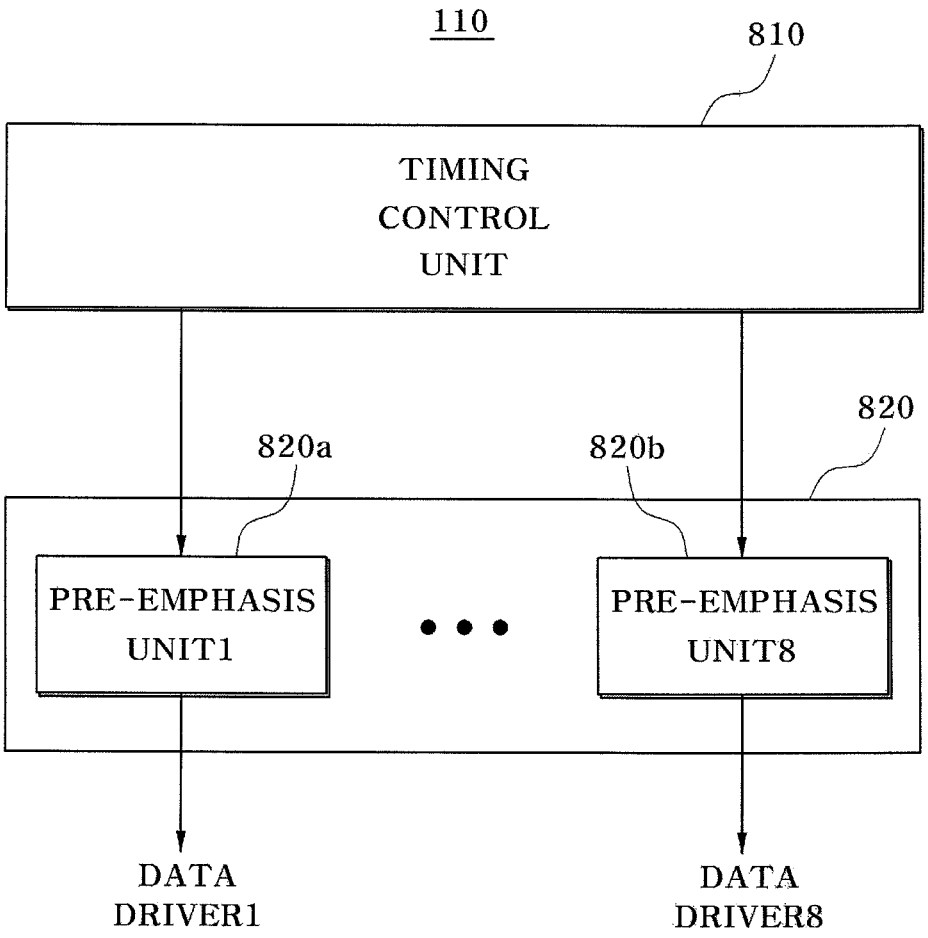
FIG. 8 is a block diagram illustrating another example embodiment of the timing controller in FIG. 1.

FIG. 8 is a block diagram illustrating another example embodiment of the timing controller in FIG. 1.

Referring to FIG. 8, the timing controller 110 may include a timing control unit 810 and a data transmission unit 820.

The data transmission unit 820 may include a plurality of pre-emphasis units 820*a* to 820*h* corresponding to each of the data drivers 120*a* to 120*h*. A distance between the data transmission unit 820 and the corresponding data driver 120 may be preset for each of the pre-emphasis units 820*a* to 820*h*. Also, the timing control unit 810 may transmit data to each of the pre-emphasis units 820*a* to 820*h*.

Since the timing controller 110 of FIG. 8 is substantially the same as the timing controller 110 of FIG. 5 except that a driver address is not used, a detailed description thereof will be omitted here.

When comparing the timing controller 110 of FIG. 5 with the timing controller 110 of FIG. 8, the timing controller 110 of FIG. 5 may simplify hardware, while the timing controller 110 of FIG. 8 may increase processing speed.

Figure 9:
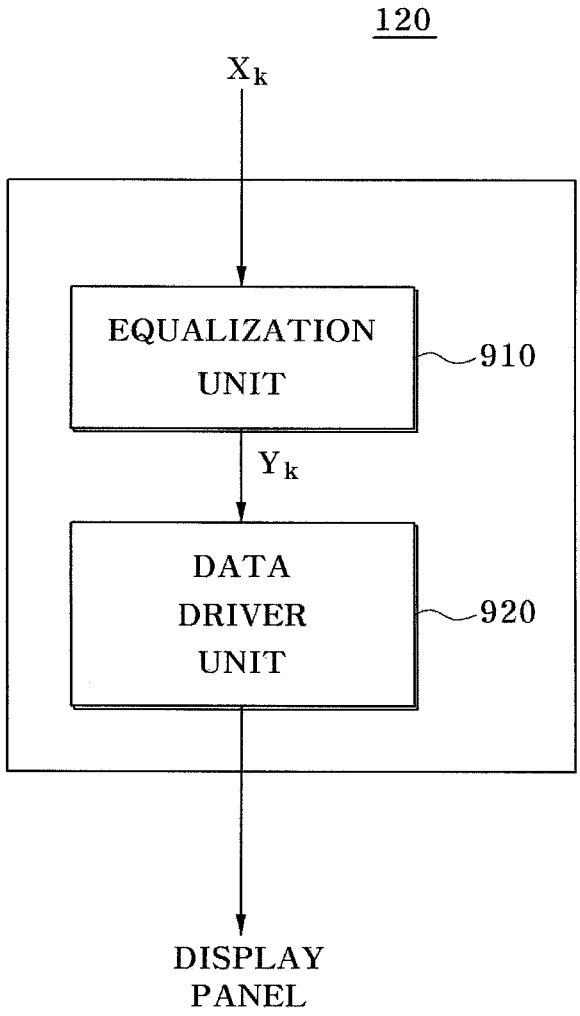
FIG. 9 is a block diagram illustrating the data driver in FIG. 1.

FIG. 9 is a block diagram illustrating the data driver in FIG. 1.

Referring to FIG. 9, the data driver 120 may include an equalization unit 910 and a data driver unit 920.

The data driver 120 of FIG. 9 may be used apart from the timing controller 110 shown in FIG. 5 or 8 or combined with the timing controller 110 shown in FIG. 5 or 8.

The equalization unit 910 may equalize an electrical signal using an equalization coefficient preset based on a distance difference between the timing controller 110 (or the data transmission unit 520 or 820) and the data driver 120.

Specifically, when the data driver 120 of FIG. 9 is used apart from the timing controller 110 of FIG. 5 or FIG. 8, the equalization unit 910 may equalize an electrical signal based on a distance difference between the timing controller 110 and the data driver 120. However, when the data driver 120 in FIG. 9 combines with the timing controller 110 in FIG. 5 or FIG. 8, the equalization unit 910 may equalize an electrical signal based on a distance difference between the data transmission unit 520 or 820 and the data driver 120.

The data driver unit 920 performs substantially the same operation as a data driver in a typical FPD. In other words, the data driver unit 920 may transmit data to the display panel 140.

Figure 10:
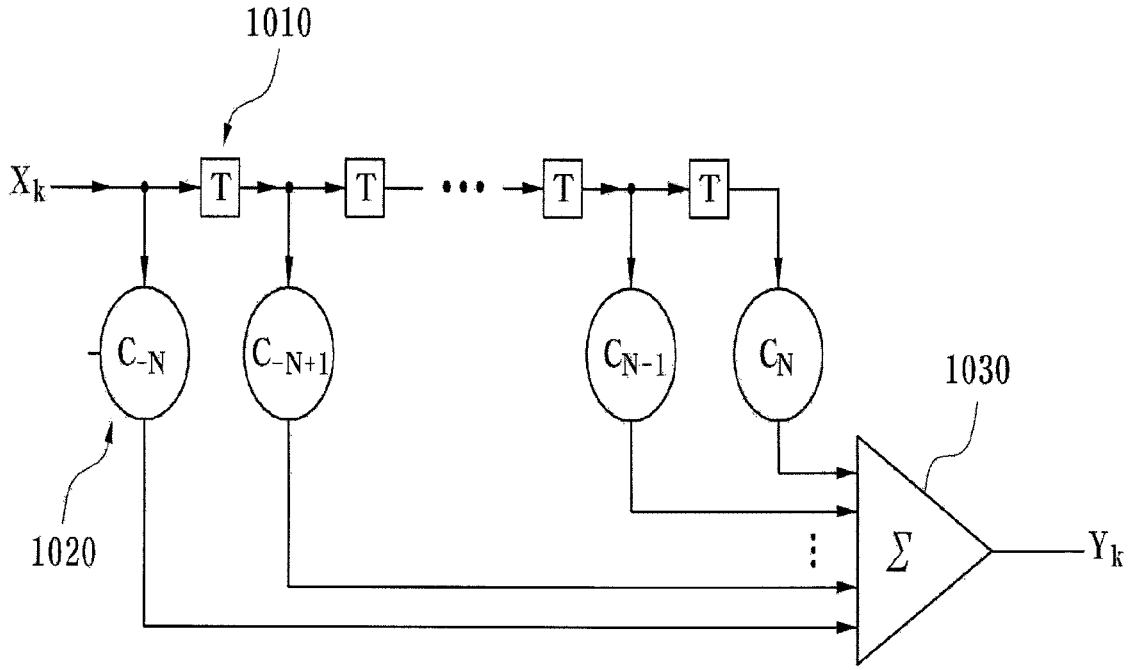
FIG. 10 is a diagram illustrating an equalization unit in FIG. 9.

FIG. 10 is a diagram illustrating an equalization unit in FIG. 9.

Referring to FIG. 10, the equalization unit 910 may include a delay unit 1010, an equalization coefficient unit 1020, and a summing unit 1030.

The delay unit 1010 may be implemented by a T-second tab and may delay a signal inputted to the equalization unit 910. The equalization coefficient unit 1020 may preset an equalization coefficient and may amplify a signal outputted from the T-second tab based on the equalization coefficient. The summing unit 1030 may sum up the signals amplified by the equalization coefficient unit 1020.

An equalization coefficient may be set based on a distance difference between the timing controller 110 (or the data transmission unit 520 or 820) and the data driver 120. One skilled in the art may obtain an appropriate equalization coefficient without excessive experimentation.

As a result, the equalization unit 910 may equalize an electrical signal based on the preset equalization coefficient, thereby reducing distortion of the electrical signal and/or power consumption.

A display driving device according to an example embodiment may reduce distortion of an electrical signal and/or power consumption that may occur due to a distance difference between a timing controller and each of the data drivers.

While the present invention has been particularly shown and described with reference to example embodiments thereof, it will be understood by those of ordinary skill in the art that various changes in forms and details may be made therein without departing from the spirit and scope of the present invention as defined by the following claims.

What is claimed is:

1. A display driving device comprising a plurality of data drivers and a timing controller, wherein:

the timing controller comprises a timing control unit and a data transmission unit;

the timing control unit is configured to transmit data to the data transmission unit; and the data transmission unit comprises:

a plurality of pre-emphasis units, the pre-emphasis units are configured to perform pre-emphasis on the data with pre-emphasis levels predetermined as per each of the pre-emphasis units, wherein the data transmission unit transmits the pre-emphasized data to the data drivers, wherein the pre-emphasized data comprises a first pre-emphasized portion, a second pre-emphasized portion, and a normal portion, the first pre-emphasized portion having a higher maximum amplitude value than a maximum amplitude value of the normal portion, and the second pre-emphasized portion having a lower minimum amplitude value than a minimum amplitude value of the normal portion, and wherein the pre-emphasis units each comprises:

a finite impulse response (FIR) filter configured to output an electrical signal an amplitude of which is determined by comparing an amplitude of a present electrical signal and an amplitude of a previous electrical signal, a mixer configured to output a signal an amplitude of which is determined by a difference of a distance between the data drivers and the timing controller, and a summing unit configured to add the present electrical signal and the signal output from the mixer to form the pre-emphasized data.

2. The display driving device of claim 1, wherein the predetermined pre-emphasis levels are based on the difference of the distance between each of the data drivers and the timing controller.

3. The display driving device of claim 1, wherein a peak-peak voltage of the pre-emphasized data increases with an increase in the difference of the distance.

4. The display driving device of claim 1, wherein the data transmission unit sequentially transmits the electrical signal to each of the data drivers.

5. The display driving device of claim 1, wherein the data transmission unit transmits the electrical signal to at least some of the data drivers at the same time.

6. The display driving device of claim 1, wherein each of the data drivers comprises an equalization unit, wherein the equalization unit is configured to use an equalization coefficient preset based on the difference of the distance to equalize the transmitted electrical signal.

7. The display driving device of claim 1, wherein each of the plurality of pre-emphasis units corresponds to one of the data drivers.

8. The display driving device of claim 1, wherein a peak to peak value of the pre-emphasized data varies corresponding to a distance between the data transmission unit and a respective data driver associated with a corresponding pre-emphasis unit.

9. The display driving device of claim 8, wherein each distance between the data transmission unit and respective data driver is recognized based on a corresponding driver address associated with the respective data driver.

10. The display driving device of claim 1, wherein the predetermined pre-emphasis levels of each of the pre-emphasis units is set based on a distance between the data transmission unit and a respective data driver associated with a corresponding pre-emphasis unit.

11. The display driving device of claim 10, wherein each distance between the data transmission unit and respective data driver is recognized based on a corresponding driver address associated with the respective data driver.

12. The display driving device of claim 1, wherein the difference of the distance between the data drivers and the timing controller are decided based on a driver address transmitted from the timing control unit.

13. The display driving device of claim 12, wherein the difference of the distance between each of the data drivers and the timing controller is recognized based on a corresponding driver address associated with the respective data driver.

14. The display driving device of claim 1, the first pre-emphasized portion, the second pre-emphasized portion, and the normal portion are all portions of a single signal.

15. The display driving device of claim 14, wherein the single signal, of which the first pre-emphasized portion, the second pre-emphasized portion, and the normal portion are portions thereof, is a single pulse.

16. The display driving device of claim 14, wherein the single signal, of which the first pre-emphasized portion, the second pre-emphasized portion, and the normal portion are portions thereof, is a single wave of a waveform signal of the data.

* * * * *